US011292987B2

(12) United States Patent
Dardas et al.

(10) Patent No.: US 11,292,987 B2
(45) Date of Patent: Apr. 5, 2022

(54) ACTIVE FILTER FOR OIL-FREE REFRIGERANT COMPRESSOR

(71) Applicant: Carrier Corporation, Palm Beach Gardens, FL (US)

(72) Inventors: Zissis A. Dardas, Worcester, MA (US); Ulf J. Jonsson, South Windsor, CT (US); Ying She, East Hartford, CT (US); Zaffir A. Chaudhry, S. Glastonbury, CT (US); Vishnu M. Sishtla, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 123 days.

(21) Appl. No.: 16/499,714

(22) PCT Filed: Mar. 22, 2018

(86) PCT No.: PCT/US2018/023685
§ 371 (c)(1),
(2) Date: Sep. 30, 2019

(87) PCT Pub. No.: WO2018/183068
PCT Pub. Date: Oct. 4, 2018

(65) Prior Publication Data

US 2021/0189286 A1 Jun. 24, 2021

Related U.S. Application Data

(60) Provisional application No. 62/478,364, filed on Mar. 29, 2017.

(51) Int. Cl.
*C10M 171/00* (2006.01)
*F25B 41/40* (2021.01)
(Continued)

(52) U.S. Cl.
CPC .. *C10M 171/008* (2013.01); *C10M 175/0091* (2013.01); *F25B 31/026* (2013.01);
(Continued)

(58) Field of Classification Search
CPC ..... C10M 175/00; C10M 175/0091; C10M 171/008; C10N 2220/30; C10N 2230/06;
(Continued)

(56) References Cited

U.S. PATENT DOCUMENTS 3,783,629 A 1/1974 Phillips
5,089,119 A 2/1992 Day et al.
(Continued)

FOREIGN PATENT DOCUMENTS

CN 1238442 A 12/1999
CN 102089400 A 6/2011
(Continued)

OTHER PUBLICATIONS

Cont. Below—NPL reference No. XP002781236, Title: Refrigerator—has release mechanism which releases additive agent gradually to mix with coolant, Author: Kawakami T; Nakajima K; Ozaki Y; Sato N, Publication data: WPI / 2017 Clarivate Analytics.
(Continued)

*Primary Examiner* — Vishal V Vasisth
(74) *Attorney, Agent, or Firm* — Cantor Colburn LLP

(57) ABSTRACT

A compressor system includes a compressor including a compressor inlet, a compressor outlet, and a bearing assembly, the compressor configured to compress a heat transfer fluid. An additive dispenser is fluidly coupled to the compressor upstream of the bearing assembly. The additive dispenser is configured to controllably release a volume of an additive material into the heat transfer fluid, the additive material configured to lubricate the bearing assembly. A method of lubricating a bearing assembly of compressor
(Continued)

includes locating a volume of additive material at an additive dispenser fluidly coupled to a compressor, dispensing a portion of the additive material into the flow of heat transfer fluid at a selected time, flowing the heat transfer fluid containing the additive material to a bearing assembly of the compressor, and lubricating the bearing assembly of the compressor with the additive material.

18 Claims, 2 Drawing Sheets

(51) Int. Cl.

| | |
|---|---|
| ***C10M 175/00*** | (2006.01) |
| ***F25B 31/02*** | (2006.01) |
| *C10N 20/00* | (2006.01) |
| *C10N 40/30* | (2006.01) |
| *C10N 50/08* | (2006.01) |
| *C10N 50/10* | (2006.01) |

(52) U.S. Cl.
CPC ..... *F25B 41/40* (2021.01); *C10N 2020/097* (2020.05); *C10N 2040/30* (2013.01); *C10N 2050/08* (2013.01); *C10N 2050/10* (2013.01)

(58) Field of Classification Search
CPC ..... C10N 2240/02; C10N 2240/30; C10N 2250/08; C10N 2250/10; C10N 2040/30; F25B 43/00; F25B 43/003; F25B 2339/0441
See application file for complete search history.

(56) References Cited

U.S. PATENT DOCUMENTS

| | | | |
|---|---|---|---|
| 5,957,676 | A | 9/1999 | Peeters |
| 6,082,132 | A | 7/2000 | Numoto et al. |
| 8,113,799 | B2 | 2/2012 | Wu et al. |
| 8,801,412 | B2 | 8/2014 | Ikeda et al. |
| 9,149,759 | B2 | 10/2015 | Dillon et al. |
| 9,404,678 | B2 | 8/2016 | Van Horn et al. |
| 2007/0214827 | A1 | 9/2007 | Venkatasubramaniam |
| 2009/0291865 | A1* | 11/2009 | Brennan ..... C10M 167/00 508/100 |
| 2011/0194960 | A1 | 8/2011 | Wu et al. |
| 2014/0352351 | A1 | 12/2014 | Xu |
| 2015/0353800 | A1 | 12/2015 | Kujak |
| 2016/0010691 | A1 | 1/2016 | Lapp et al. |
| 2016/0115950 | A1 | 4/2016 | Ikeda et al. |

FOREIGN PATENT DOCUMENTS

| | | | |
|---|---|---|---|
| CN | 105132086 | A | 12/2015 |
| EP | 2589895 | A1 | 5/2013 |
| JP | 10132398 | A | 5/1998 |
| JP | 2008163923 | A | 7/2008 |
| WO | 2014150886 | A1 | 9/2014 |
| WO | 2015142825 | A1 | 9/2015 |

OTHER PUBLICATIONS

Cont. From Above—May 22, 1998, Source information: vol. 1998, Nr:31, Publisher accession No. 1998-351122, Patent applicant: Matsushita Denki Sangyo KK, Publication No. JP00H10132398A A, 3 Pages.

International Search Report for International Application No. PCT/US2018/023685; International Filing Date Mar. 22, 2018; dated Jun. 12, 2018; 6 Pages.

Written Opinion for International Application No. PCT/US2018/023685; International Filing Date Mar. 22, 2018; dated Jun. 12, 2018; 8 Pages.

Chinese Office Action for Chinese Application No. 201880022029.6; dated Aug. 25, 2021; 9 pages.

* cited by examiner

ACTIVE FILTER FOR OIL-FREE REFRIGERANT COMPRESSOR

CROSS REFERENCE TO RELATED APPLICATIONS

This application is a National Stage application of PCT/US2018/023685, filed Mar. 22, 2018, which claims the benefit of U.S. Provisional Application No. 62/478,364, filed Mar. 29, 2017, both of which are incorporated herein by reference in their entirety.

BACKGROUND

The present disclosure generally relates to compressors, and more particularly to refrigerant compressors for heating ventilation, air conditioning and refrigeration (HVAC&R) systems.

HVAC&R system components, such as compressor bearings, require lubrication to extend their life and prevent corrosion. An oil system is typically provided, which circulates oil through the compressor to lubricate the bearings. In other HVAC&R systems, "oil-free" lubrication is provided. Such HVAC&R systems are referred to as "oil-free", because there is no separate oil system circulating oil through the compressor to lubricate the compressor bearing. In oil-free systems, additives are added to the refrigerant circulating through the HVAC&R system. The additives are utilized to generate via in situ chemical reactions a protective tribolayer at the outer surface of the compressor bearings, and to protect the bearing surfaces from corrosion and corrosive by-products of the refrigerant reactions with the metal bearing surfaces via formation of a surface passivation. Such additives are typically added when the HVAC&R system is charged with refrigerant, then requires periodic monitoring of the additive level present in the refrigerant and manually adding additional additive to bring the quantity of additive in the refrigerant to a selected level.

BRIEF SUMMARY

In one embodiment, a compressor system includes a compressor including a compressor inlet, a compressor outlet, and a bearing assembly, the compressor configured to compress a heat transfer fluid. An additive dispenser is fluidly coupled to the compressor upstream of the bearing assembly. The additive dispenser is configured to controllably release a volume of an additive material into the heat transfer fluid, the additive material configured to lubricate the bearing assembly.

Additionally or alternatively, in this or other embodiments the additive material is in the form of one of a liquid, a solid, a gel or a powder.

Additionally or alternatively, in this or other embodiments the additive dispenser is configured to periodically release or spray the additive material into the heat transfer fluid.

Additionally or alternatively, in this or other embodiments the additive dispenser is configured to dissolve the additive material into the heat transfer fluid passing the additive dispenser.

Additionally or alternatively, in this or other embodiments the additive material includes one or more of amines (alkyl, cyclo and di-cyclo aliphatic, aromatic) and their derivatives, including alkanolamines and amine salts (carboxylates, fatty acids), triazoles, including benzo-triazoles; lubricant oils selected from polyol esters, polyalkylene glycols, polyvinyl ethers, polyalpha olefins, alkylbenzenes, and these chemical species also containing polar side groups comprised of nitrogen or oxygen atoms, and more specifically the polar side groups being carboxylate, ester, aldehyde or ketone carbonyl, alcohol, nitrile, amine, amide, imide, or imidazole groups; polyaryl ether ketones including polyether ether ketones, branched polyethylenimines, polyvinyl pyridines, polyvinyl pyrrolidones, polycarbonates, polyacrylates including polyalkyl acrylates, polyalkyl and alkylacrylates, polyacrylamides, polyacrylic acids, polyacrylonitriles, or polyvinyl imidazoles.

Additionally or alternatively, in this or other embodiments the additive dispenser includes an upstream filter located upstream of the bearing assembly to remove undesired material from the heat transfer fluid.

Additionally or alternatively, in this or other embodiments a downstream filter is located downstream of the bearing assembly to remove undesired material from the heat transfer fluid.

In another embodiment, a heating, ventilation, air conditioning and refrigeration (HVAC&R) system includes a heat transfer circuit including a heat transfer fluid conduit fluidly coupling a compressor, a condenser and an evaporator. The compressor includes a compressor inlet, a compressor outlet, and a bearing assembly and the compressor is configured to compress a heat transfer fluid. An additive dispenser is fluidly coupled to the compressor upstream of the bearing assembly. The additive dispenser is configured to controllably release a volume of an additive material into the heat transfer fluid. The additive material is configured to lubricate the bearing assembly.

Additionally or alternatively, in this or other embodiments the additive material is in the form of one of a liquid, a solid, a gel or a powder.

Additionally or alternatively, in this or other embodiments the additive dispenser is configured to periodically release or spray the additive material into the heat transfer fluid.

Additionally or alternatively, in this or other embodiments the additive dispenser is configured to dissolve the additive material into the heat transfer fluid passing the additive dispenser.

Additionally or alternatively, in this or other embodiments the additive material includes one or more of amines (alkyl, cyclo and di-cyclo aliphatic, aromatic) and their derivatives, including alkanolamines and amine salts (carboxylates, fatty acids), triazoles, including benzo-triazoles; lubricant oils selected from polyol esters, polyalkylene glycols, polyvinyl ethers, polyalpha olefins, alkylbenzenes, and these chemical species also containing polar side groups comprised of nitrogen or oxygen atoms, and more specifically the polar side groups being carboxylate, ester, aldehyde or ketone carbonyl, alcohol, nitrile, amine, amide, imide, or imidazole groups, polyaryl ether ketones including polyether other ketones, branched polyethylenimines, polyvinyl pyridines, polyvinyl pyrrolidones, polycarbonates, polyacrylates including polyalkyl acrylates, polyalkyl and alkylacrylates, polyacrylamides, polyacrylic acids, polyacrylonitriles, or polyvinyl imidazoles.

Additionally or alternatively, in this or other embodiments the additive dispenser includes an upstream filter located upstream of the bearing assembly to remove undesired material from the heat transfer fluid.

Additionally or alternatively, in this or other embodiments a downstream filter is located downstream of the bearing assembly to remove undesired material from the heat transfer fluid.

In another embodiment, a method of lubricating a bearing assembly of a compressor of a heating, ventilation, air conditioning and refrigeration (HVAC&R) system includes locating a volume of additive material at an additive dispenser fluidly coupled to a compressor, the compressor configured to compress a flow of heat transfer fluid flowing therethrough, dispensing a portion of the additive material into the flow of heat transfer fluid at a selected time, flowing the heat transfer fluid containing the additive material to a bearing assembly of the compressor, and lubricating the bearing assembly of the compressor with the additive material.

Additionally or alternatively, in this or other embodiments dispensing a portion of the additive material includes periodically releasing or spraying the additive material from the additive dispenser into the heat transfer fluid.

Additionally or alternatively, in this or other embodiments dispensing a portion of the additive material includes dissolving a solid additive material into the heat transfer fluid passing the additive dispenser.

Additionally or alternatively, in this or other embodiments undesired material is filtered from the heat transfer fluid at an upstream filter located upstream of the bearing assembly of the compressor.

Additionally or alternatively, in this or other embodiments undesired material is filtered from the heat transfer fluid at a downstream filter located downstream of the bearing assembly of the compressor.

Additionally or alternatively, in this or other embodiments the additive material includes one or more of amines (alkyl, cyclo and di-cyclo aliphatic, aromatic) and their derivatives, including alkanolamines and amine salts (carboxylates, fatty acid), triazoles, including benzo-triazoles; lubricant oils selected from polyol esters, polyalkylene glycols, polyvinyl ethers, polyalpha olefins, alkylbenzenes, and these chemical species also containing polar side groups comprised of nitrogen or oxygen atoms, and more specifically the polar side groups being carboxylate ester, aldehyde or ketone carbonyl, alcohol, nitrile, amine, amide, or imidazole groups; polyaryl ether ketones including polyether ether ketones, branched polyethylenimines, polyvinyl pyridines, polyvinyl pyrrolidones, polycarbonates, polyacrylates including polyalkyl acrylates, polyalkyl and alkylacrylates, polyacrylamides, polyacrylic acids, polyacrylonitriles, or polyvinyl imidazoles.

BRIEF DESCRIPTION OF THE DRAWINGS

The subject matter is particularly pointed out and distinctly claimed at the conclusion of the specification. The foregoing and other futures, and advantages of the present disclosure are apparent from the following detailed description taken in conjunction with the accompanying drawings in which:

DETAILED DESCRIPTION

Figure 1:
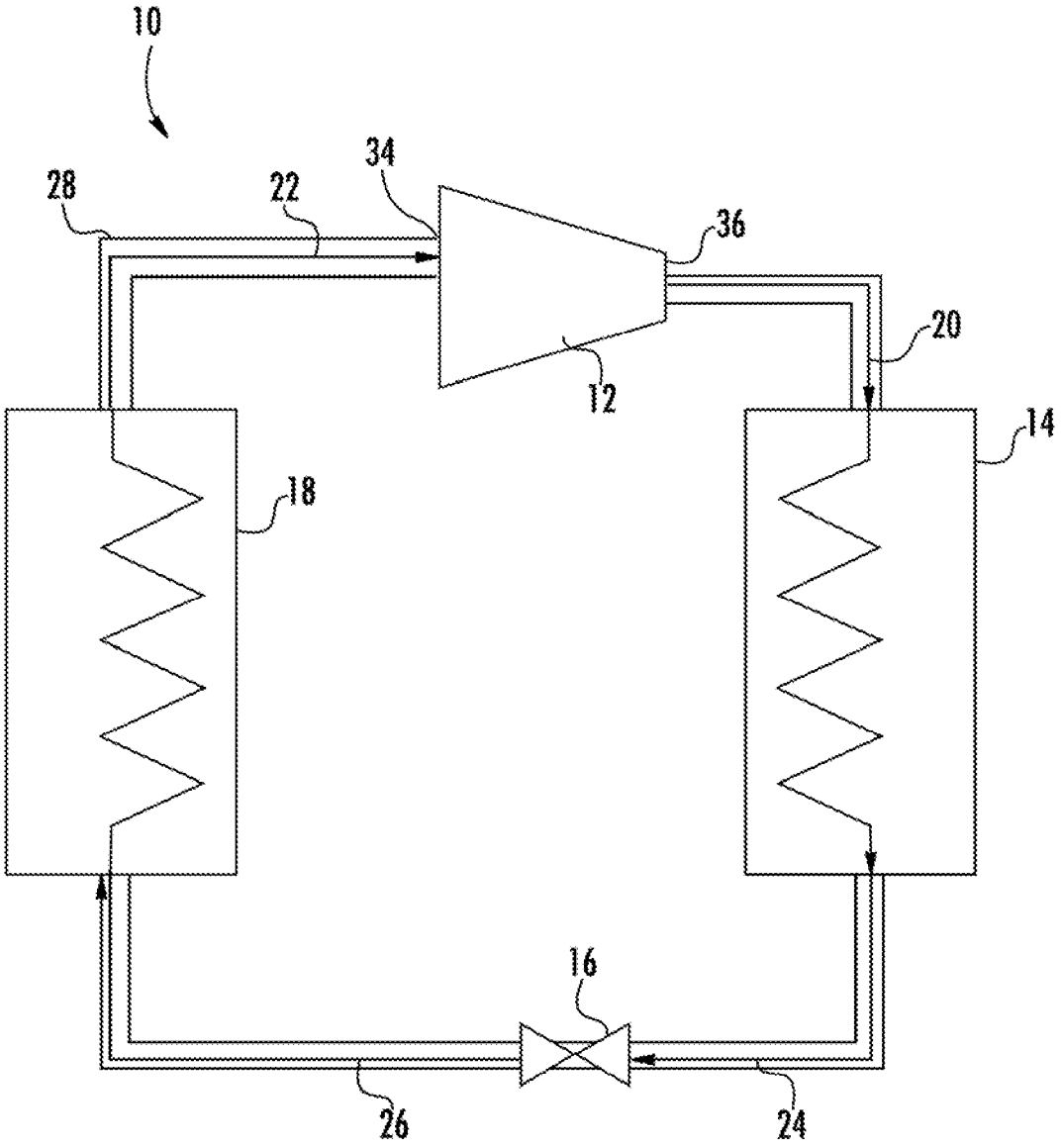
FIG. 1 is schematic illustration of a heating, ventilation, air conditioning and refrigeration (HVAC&R) system.

Referring now to FIG. 1, shown is an exemplary heat transfer system, for example, a heating, air conditioning, ventilation and refrigeration (HVAC&R) system 10. The HVAC&R system 10 includes a compressor 12, a condenser 14, an expansion device 16 and an evaporator 18 serially connected by conduits 20, 24, 26 and 28.

In operation, the compressor 12 pressurizes a refrigerant or heat transfer fluid 22, which both heats the heat transfer fluid 22 and provides pressure to circulate the heat transfer fluid 22 through the HVAC&R system 10. In some embodiments, the heat transfer fluid 22 is a halocarbon refrigerant with a hydrocarbon substituted with one or more halogen atoms on the molecule. The hot pressurized gaseous heat transfer fluid 22 exiting the compressor 12 flows through conduit 20 to the condenser 14 or other heat rejection heat exchanger to transfer thermal energy from the heat transfer fluid 22 to the surrounding environment, resulting in condensation of the heat transfer fluid 22 to a pressurized moderate temperature liquid at the condenser 14.

The liquid heat transfer fluid 22 exiting the condenser 14 flows through conduit 24 to the expansion device 16, in some embodiments an expansion valve. The pressure of the heat transfer fluid 22 is reduced at the expansion device 16, and the heat transfer fluid 22 then flows to the evaporator 18 or other heat absorption heat exchanger via conduit 26. The evaporator 18 absorbs thermal energy from the environment surrounding the evaporator 18 and utilizes the absorbed thermal energy to boil the heat transfer fluid 22 flowing through the evaporator 18. Gaseous heat transfer fluid 22 exiting the evaporator 18 flows to the compressor 12 via the conduit 28.

The HVAC&R system 10 transfers thermal energy from the environment surrounding the evaporator 18 to the environment surrounding the condenser 14. The thermodynamic properties of the heat transfer fluid 22 allow the heat transfer fluid 22 to reach a sufficiently high temperature when compressed at the compressor 12 so that temperature is greater than that of the temperature of the environment surrounding the condenser 14, allowing thermal energy to be transferred to the environment surrounding the condenser 14. Further, the heat transfer fluid 22 must have a boiling point at its post-expansion pressure that allows the environment surrounding the evaporator 18 to boil the heat transfer fluid 22.

The HVAC&R system 10 may be used as an air conditioning system, in which the condenser 14 is in thermal contact with an outside environment, and the evaporator 18 is thermally connected to air in an interior environment to be conditioned or cooled. Further, in other embodiments the HVAC&R system 10 may be operated as a heat pump using a standard multipart switching valve (not shown) to reverse flow direction of the heat transfer fluid 22 and function of the condenser 14 and evaporator 18 depending on whether the HVAC&R system 10 is operating in a heating mode or in a cooling mode. Additionally, while the HVAC&R system 10 shown in FIG. 1 has condensation and evaporation stages for efficient thermal energy transfer, other types of thermal energy transfer loops may be utilized within the scope of the present disclosure, for example, thermal energy transfer loops without a phase change.

Figure 2:
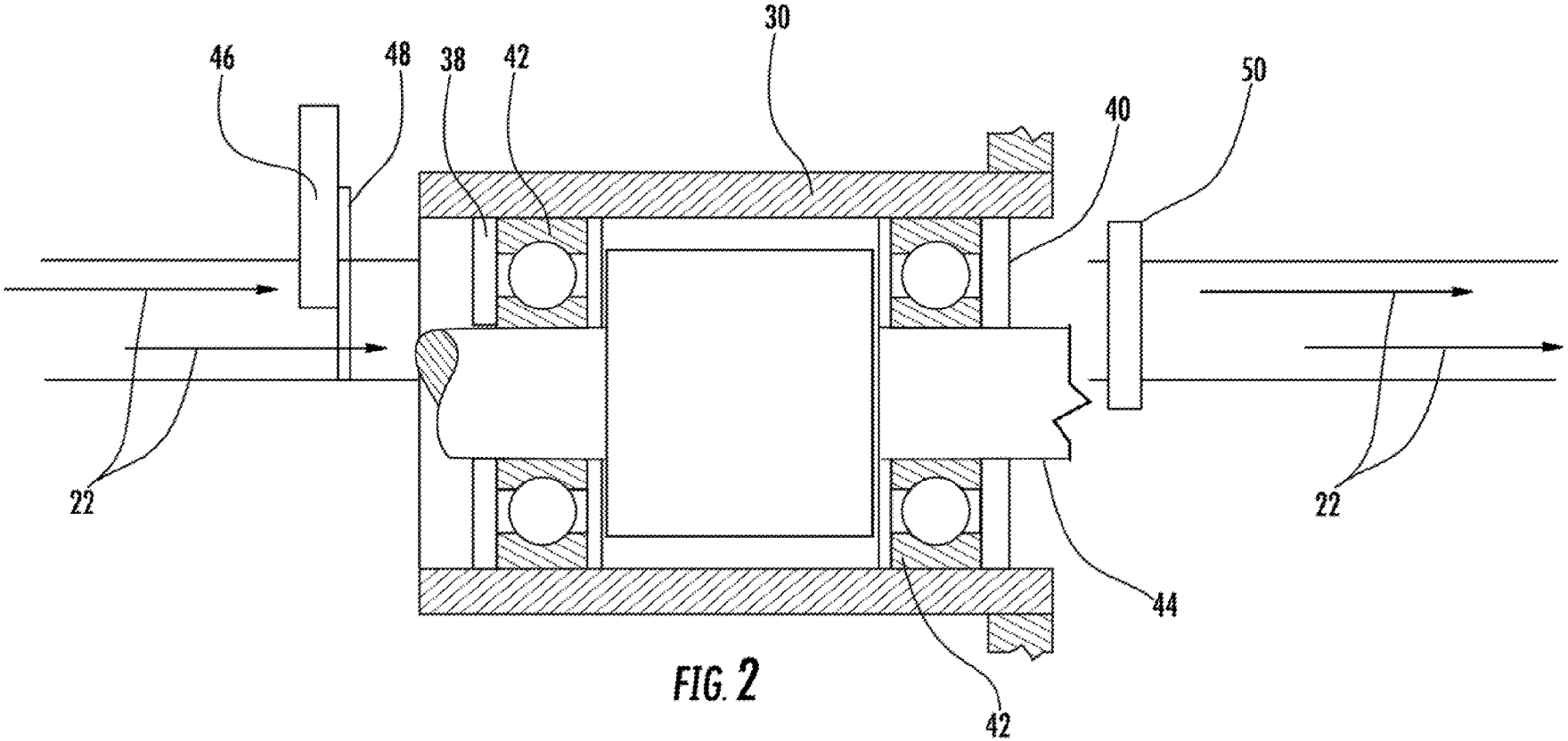
FIG. 2 is a cross-sectional view of an embodiment of a compressor for a heating, ventilation, air conditioning and refrigeration (HVAC&R) system.

Referring now to the cross-sectional view of FIG. 2, the compressor 12 is illustrated in more detail. In the exemplary embodiment of FIG. 2, the compressor 12 is illustrated as a centrifugal compressor 12, but in other embodiments may be another type of compressor such as a screw compressor. The compressor 12 includes a compressor housing 30 in which components of the compressor 12 are located. The compressor 12 includes a compressor inlet 34 (shown in FIG. 1) through which the heat transfer fluid 22 enters the compressor 12 and a compressor outlet 36 (shown in FIG. 1) through which the heat transfer fluid 22 exits the compressor 12. A first bearing chamber 38 and a second bearing chamber 40 are located in the compressor housing 30, and each include a bearing assembly 42 supportive of a rotating component of the compressor 12, for example a compressor shaft 44. Although the compressor 12 is illustrated with two bearing chambers 38, 40 and two bearing assemblies 42, one skilled in the art will appreciate that any suitable numbers of bearing chambers and bearing assemblies 42 may be utilized in compressor 12.

The compressor 12 is an oil-free compressor, such that the bearing assemblies 42 and any other components are lubricated by the heat transfer fluid 22, without the use of a separate lubricant circuit or system. To facilitate lubrication of the bearing assemblies 42 by the heat transfer fluid 22, one or more additive materials are added to the heat transfer fluid 22 upstream of the bearing chambers 38, 40, either in the compressor 12 or upstream of the compressor 12. Recommended additives that create a protection layer for the bearing surfaces via strong adsorption that results in surface passivation include; Amines (alkyl, cyclo and di-cyclo aliphatic, aromatic) and their derivatives, including alkanolamines and amine salts (carboxylates, fatty acids), triazoles, including benzo-triazoles. Furthermore, recommended additives that generate a tribolayer for bearing metal surface protection include lubricant oils selected from polyol esters, polyalkylene glycols, polyvinyl ethers, polyalpha olefins, alkylbenzenes, and also the previous chemical compounds containing polar side groups comprised of nitrogen or oxygen atoms, and more specifically the polar side groups are selected from carboxylate, ester, aldehyde or ketone carbonyl alcohol nitrile, amine, amide, imide, or imidazole groups. Finally, these additives could include polyaryl ether ketones including polyether ether ketones, branched polyethylenimines, polyvinyl pyridines, polyvinyl pyrrolidones, polycarbonates, polyacrylates including polyalkyl acrylates, polyalkyl and alkylacrylates, polyacrylamides, polyacrylic acids, polyacrylonitriles, or polyvinyl imidazoles.

An additive dispenser 46 is located upstream of the bearing compartments 38, 40, in some embodiments at the compressor 12, or alternatively upstream of the compressor 12. "Upstream" is used herein as relative to a primary direction of flow of the heat transfer fluid 22 through the HVAC&R system 10. The additive dispenser 46 releases an additive material in a controlled manner into the heat transfer fluid 22 prior to the heat transfer fluid 22 reaching the bearing assemblies 42. The additive material may be in the form of a liquid or gel that is periodically released or sprayed from the additive dispenser 46, for example, at preselected time intervals during operation of the compressor 12. In other embodiments, the additive may be a solid or powder material that is dissolved into the heat transfer fluid 22 flowing past the additive dispenser 46 over time. Use of the additive dispenser 46 reduces maintenance of the HVAC&R system 10, by assuring that a sufficient amount of additive is present in the heat transfer fluid 22 stream from lubrication of the components of the bearing assemblies 42. The use of the additive dispenser 46 provides additive materials to heat transfer fluid 22 automatically, reducing the need for a maintenance technician to check a level of additive in the heat transfer fluid 22 and add additional additive as needed.

In some embodiments, the additive dispenser 46 also includes one or more upstream filter elements 48 to filter harmful corrosive species from the heat transfer fluid 22 prior to the corrosive species reaching the bearing assemblies 42, to further protect the service life of the bearing assemblies 42. Corrosive species include: acidic in nature decomposition products of the refrigerant such as HCl, HF, depending on the refrigerant; ionic in nature molecular fragments of the refrigerant molecule involving fluorine and/or chlorine ions in their structure, depending on the refrigerant; and of any containing moisture within it, typically H+ and OH−.

In some embodiments, the HVAC&R system 10 includes a downstream filter 50 in addition to or as an alternative to the upstream filter 48. The downstream filter 50 acts to remove contaminants from the heat transfer fluid 22 prior to the contaminants reaching components of the HVAC&R system 10, such as the condenser 14, the expansion device 16 and/or the evaporator 18.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A compressor system, comprising:

a compressor including a compressor inlet, a compressor outlet, and a bearing assembly, the compressor configured to compress a heat transfer fluid; and an additive dispenser fluidly coupled to the compressor upstream of the bearing assembly, the additive dispenser configured to controllably release a volume of an additive material into the heat transfer fluid, the additive material configured to lubricate the bearing assembly;

wherein the additive material is in the form of a liquid or a gel that is periodically released or sprayed from the additive dispenser at preselected time intervals during operation of the compressor.

2. The compressor system of claim 1, wherein the additive dispenser is configured to dissolve the additive material into the heat transfer fluid passing the additive dispenser.

3. The compressor system of claim 1, wherein the additive material includes one or more of amines (alkyl, cyclo and di-cyclo aliphatic, aromatic) and their derivatives, triazoles; lubricant oils selected from polyol esters, polyalkylene glycols, polyvinyl ethers, polyalpha olefins, alkylbenzenes, and these chemical species also containing polar side groups comprised of nitrogen or oxygen atoms.

4. The compressor system of claim 1, wherein the additive dispenser includes an upstream filter disposed upstream of the bearing assembly to remove undesired material from the heat transfer fluid.

5. The compressor system of claim 1, further comprising a downstream filter disposed downstream of the bearing assembly to remove undesired material from the heat transfer fluid.

6. A heating, ventilation, air conditioning and refrigeration (HVAC&R) system, comprising:

a heat transfer circuit including a heat transfer fluid conduit fluidly coupling a compressor, a condenser and an evaporator, the compressor including a compressor inlet, a compressor outlet, and a bearing assembly, the compressor configured to compress a heat transfer fluid; and an additive dispenser fluidly coupled to the compressor upstream of the bearing assembly, the additive dispenser configured to controllably release a volume of an additive material into the heat transfer fluid, the additive material configured to lubricate the bearing assembly;

wherein the additive material is in the form of a liquid or a gel that is periodically released or sprayed from the additive dispenser at preselected time intervals during operation of the compressor.

7. The HVAC&R system of claim 6, wherein the additive dispenser is configured to dissolve the additive material into the heat transfer fluid passing the additive dispenser.

8. The HVAC&R system of claim 6, wherein the additive material includes one or more of amines (alkyl, cyclo and di-cyclo aliphatic, aromatic) and their derivatives, triazoles; lubricant oils selected from polyol esters, polyalkylene glycols, polyvinyl ethers, polyalpha olefins, alkylbenzenes, and these chemical species also containing polar side groups comprised of nitrogen or oxygen atoms.

9. The HVAC&R system of claim 6, wherein the additive dispenser includes an upstream filter disposed upstream of the bearing assembly to remove undesired material from the heat transfer fluid.

10. The HVAC&R system of claim 6, further comprising a downstream filter disposed downstream of the bearing assembly to remove undesired material from the heat transfer fluid.

11. A method of lubricating a bearing assembly of a compressor of a heating, ventilation, air conditioning and refrigeration (HVAC&R) system, comprising:

locating a volume of additive material at an additive dispenser fluidly coupled to a compressor, the compressor configured to compress a flow of heat transfer fluid flowing therethrough;

dispensing a portion of the additive material into the flow of heat transfer fluid at a selected time;

flowing the heat transfer fluid containing the additive material to a bearing assembly of the compressor; and lubricating the bearing assembly of the compressor with the additive material;

wherein the additive material is in the form of a liquid or a gel and dispensing a portion of the additive material includes releasing or spraying the additive material from the additive dispenser at preselected time intervals during operation of the compressor.

12. The method of claim 11, wherein dispensing a portion of the additive material includes dissolving a solid additive material into the heat transfer fluid passing the additive dispenser.

13. The method of claim 11, further comprising filtering undesired material from the heat transfer fluid at an upstream filter disposed upstream of the bearing assembly of the compressor.

14. The method of claim 11, further comprising filtering undesired material from the heat transfer fluid at a downstream filter disposed downstream of the bearing assembly of the compressor.

15. The method of claim 11, wherein the additive material includes one or more of amines (alkyl, cyclo and di-cyclo aliphatic, aromatic) and their derivatives, triazoles; lubricant oils selected from polyol esters, polyalkylene glycols, polyvinyl ethers, polyalpha olefins, alkylbenzenes, and these chemical species also containing polar side groups comprised of nitrogen or oxygen atoms.

16. The compressor system of claim 3, wherein the polar side groups include carboxylate, ester, aldehyde or ketone carbonyl, alcohol, nitrile, amine, amide, imide, or imidazole groups; polyaryl ether ketones including polyether ether ketones, branched polyethylenimines, polyvinyl pyridines, polyvinyl pyrrolidones, polycarbonates, polyacrylates including polyalkyl acrylates, polyalkyl and alkylacrylates, polyacrylamides, polyacrylic acids, polyacrylonitriles, or polyvinyl imidazoles.

17. The HVAC&R system of claim 8, wherein the polar side groups include carboxylate, ester, aldehyde or ketone carbonyl, alcohol, nitrile, amine, amide, imide, or imidazole groups; polyaryl ether ketones including polyether ether ketones, branched polyethylenimines, polyvinyl pyridines, polyvinyl pyrrolidones, polycarbonates, polyacrylates including polyalkyl acrylates, polyalkyl and alkylacrylates, polyacrylamides, polyacrylic acids, polyacrylonitriles, or polyvinyl imidazoles.

18. The method of claim 15, wherein the polar side groups include carboxylate, ester, aldehyde or ketone carbonyl, alcohol, nitrile, amine, amide, imide, or imidazole groups; polyaryl ether ketones including polyether ether ketones, branched polyethylenimines, polyvinyl pyridines, polyvinyl pyrrolidones, polycarbonates, polyacrylates including polyalkyl acrylates, polyalkyl and alkylacrylates, polyacrylamides, polyacrylic acids, polyacrylonitriles, or polyvinyl imidazoles.

* * * * *